US005438944A

United States Patent [19]

Burke

[11] Patent Number: 5,438,944

[45] Date of Patent: Aug. 8, 1995

[54] SURFACE MOUNTED COLLAPSIBLE MOORING CLEAT AND HOUSING

[76] Inventor: David W. Burke, 809 Taylor St., Bay City, Mich. 48708

[21] Appl. No.: 320,131

[22] Filed: Sep. 29, 1994

[51] Int. Cl.[6] ..... B63H 21/04

[52] U.S. Cl. ..... 114/218

[58] Field of Search ..... 114/218; 410/96, 101, 410/106, 107, 108, 110, 111

[56] References Cited

U.S. PATENT DOCUMENTS 2,856,865 10/1958 Reynolds et al. ..... 410/111
2,870,733 1/1959 Winther ..... 114/218
4,907,921 3/1990 Akright ..... 410/111
4,964,355 10/1990 Milewski ..... 114/218

*Primary Examiner*—Sherman Basinger
*Attorney, Agent, or Firm*—Merlin B. Davey

[57] ABSTRACT

This invention provides a surface mounted collapsible mooring cleat and a housing that is routed and adapted to contain a fixed pin and a collapsed mooring cleat. The cleat comprises a top portion having generally opposed extending arms, and a bottom portion mounted on the pin and being rotatable about the pin whereby the cleat may be rotated from a non-use position within the housing to a use position extending above the housing.

1 Claim, 1 Drawing Sheet

SURFACE MOUNTED COLLAPSIBLE MOORING CLEAT AND HOUSING

BACKGROUND OF THE INVENTION

1. Field of the Invention

This invention relates to a surface mounted collapsible mooring cleat and housing that is readily positioned on a dock or boat deck. The housing is configured so as to encompass the cleat in a non-operative and non-obstructing position while permitting the ready positioning of the cleat for use when mooring a boat to a dock or pier.

2. State of the Prior Art

There are many different types of retractable and/or flush mounted cleats such as, for example, those described in U.S. Pat. Nos. 4,964,355; 1,402,496 and 4,788,927. While providing means for retracting cleats so that there is a flat surface when the cleats are not in use, such means require the formation of a cavity in the surface to which the cleat is to be attached, thereby weakening, for example, a boat dock or pier which is generally made from boards no thicker than 2 or 3 inches. It is, therefore, a desideratum of the art to provide a cleat that does not weaken the surface to which it is attached but still provides a greatly reduced obstruction when not in use.

SUMMARY OF THE INVENTION

This invention provides a surface mounted collapsible mooring cleat and housing, said housing having a top surface and a bottom surface, said top surface being routed and adapted to contain a fixed pin and a collapsed mooring cleat, said cleat comprising a top portion and a bottom portion, said top portion having generally opposed extending arms, said bottom portion being mounted on said pin and being rotatable about said pin whereby said cleat may be rotated from a non-use position within said housing to a use position extending above said housing.

DETAILED DESCRIPTION

Figure 1:
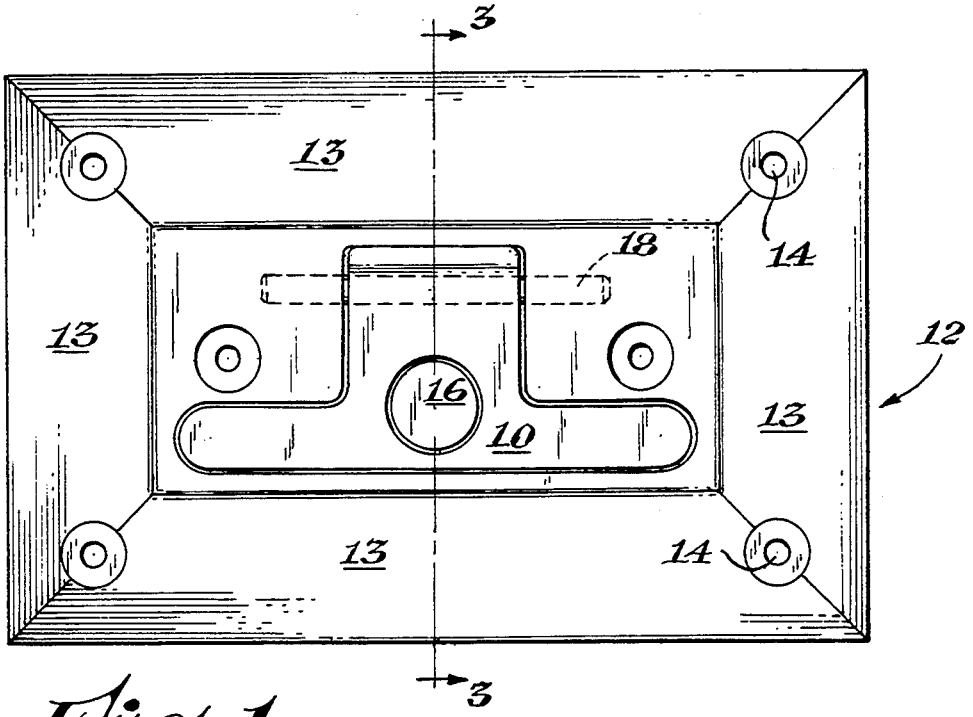
FIG. 1 is a top view of one embodiment of the cleat and housing of this invention showing the cleat in the collapsed, non-operating position.

Referring to FIG. 1, mooring cleat 10 is shown in a collapsed position in housing 12. Housing 12 has sloping sides 13, counter-sunk holes 14 for lag bolts or other means of attachment to a boat deck or pier and is routed or formed to contain cleat 10 and pin 18.

Figure 2:
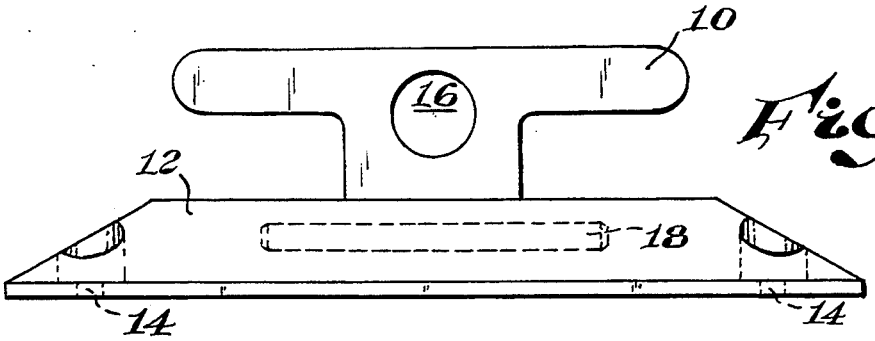
FIG. 2 is a front elevation of a cleat and housing of this invention showing the cleat in the raised or operating position.

Housing 12 and cleat 10 are advantageously made of metal castings or rigid plastics such as, for example, nylon or 33% glass-filled nylon. For ease of noticing, it is desirable that plastics materials be colored or contain fluorescent materials. Pin 18 is preferably steel or stainless steel. A hole 16 provides a means for grasping cleat 10 to pull it upward and rotate about pin 18 to the upright, working position shown in FIG. 2.

Figure 3:
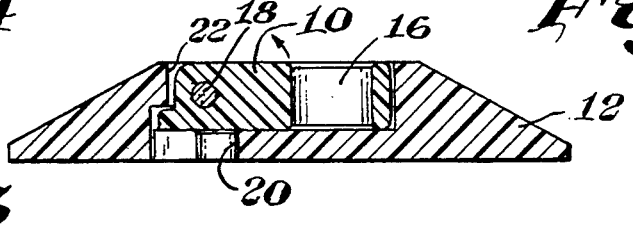
FIG. 3 is taken along the lines 3—3 of FIG. 1, and illustrates the positioning of the bottom portion of the cleat and the pin within the housing when the cleat is in the collapsed position.

In FIG. 3, it is seen that when cleat 10 is rotated upward and to the left to the raised operating position about pin 18, the bottom portion of cleat 10 will abut surfaces 20 and 22 of housing 12, above and below pin 18, thereby forming an effective stop to hold a moored boat or ship without placing an undue strain on pin 18 when a mooring line is stressed.

Figure 4:
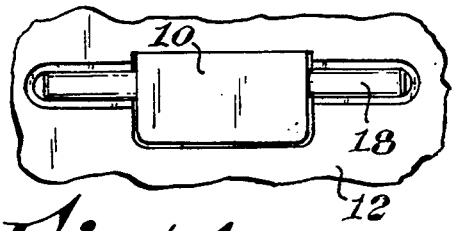
FIG. 4 is a cut-away bottom view illustrating the positioning of the pin and bottom portion of the cleat when the cleat is in the non-operating position.
Figure 5:
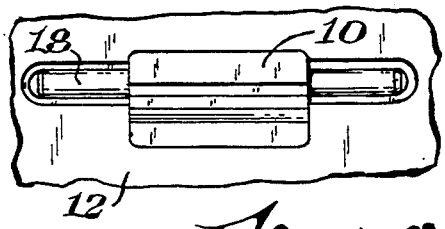
FIG. 5 is a cut-away bottom view illustrating the positioning of the pin and bottom portion of the cleat when the cleat is in the raised or operating position.

FIG. 4 illustrates the positioning of the pin 18 and bottom portion of the cleat 10 when the cleat is in the non-operating position and FIG. 5 illustrates the positioning of the pin 18 and bottom portion of the cleat 10 when the cleat 10 is in the raised or operating position.

To assemble cleat 10, pin 18 and housing 12, the bottom portion of cleat 10 is inserted into housing 12 between surfaces 20 and 22 (FIG. 5) after which pin 18 is inserted in a preformed tubular cavity in the bottom portion of cleat 10, which is then pulled upward to force pin 18 into an appropriate slot in housing 12.

The cleat and housing of this invention may be made of any rigid material such as, for example, plastics, wood or metal castings, but are advantageously made of rigid plastics such as, for example, 33% glass-filled nylon. The plastics materials may contain coloring agents and/or fluorescent materials so that they are more noticeable in the dark. The top surface of the housing 12 is advantageously shaped with sloping sides to each edge to minimize obstruction when the cleat is not in use. Pin 18 is advantageously made of steel, preferably stainless steel for long service.

By surface mounting the cleat of this invention, rather than flush mounting, the pier or boat deck is strengthened rather than weakened as when a 2 inch by 6 inch board of a pier or dock is routed to make room for a flush mounted cleat.

The mooring cleat and housings of this invention may be made in various sizes and dimensions depending on the use to which they are to be put, it being obvious that cleats for mooring large boats or ships will be larger than those required for small boats.

The particular shape and dimensions of the mooring cleat and housing of this invention are not critical, it being necessary that the dimensions and materials of construction be sufficient to provide the desired strength and utility. The shape may be rectangular, as depicted, ellipsoidal or otherwise as will be apparent to those skilled in the art, it being only necessary and desirable that the sides be sloping to afford as little obstruction as possible while maintaining the necessary strength and toughness.

Various modifications may be made in the present invention without departing from the spirit or scope thereof as will be readily apparent to those skilled in the art.

I claim:

1. A surface mounted collapsible mooring cleat and housing, said housing having a top surface and a bottom surface and sloping sides, said top surface being routed and adapted to contain a fixed pin and said cleat, said cleat comprising a top portion and a bottom portion, said top portion having generally opposed extending arms, said bottom portion being positionable on said pin and being rotatable about said pin whereby said cleat may be rotated from a non-use position within said housing to a use position extending above said housing, and wherein said bottom portion of said cleat abuts said housing above and below said pin and on opposite sides of said pin when said cleat is in an upright, operative position.

* * * * *